United States Patent [19]

Nagata et al.

[11] 4,030,884

[45] June 21, 1977

[54] METHOD FOR CONTINUOUSLY WASHING A YARN WITH A WASHING LIQUID

[75] Inventors: Yasunori Nagata, Osaka; Hirotaka Itoh, Neyagawa; Susumu Yazaki, Settsu; Takayuki Hamamura, Kyoto; Shigeo Yoshiya, Fujiidera, all of Japan

[73] Assignee: Kanebo, Ltd., Japan

[22] Filed: Jan. 22, 1976

[21] Appl. No.: 651,575

Related U.S. Application Data

[62] Division of Ser. No. 465,611, April 30, 1974, Pat. No. 3,964,279.

[30] Foreign Application Priority Data

| | | |
|---|---|---|
| May 7, 1973 | Japan | 48-50514 |
| July 4, 1973 | Japan | 48-75567 |
| Nov. 21, 1973 | Japan | 48-131306 |

[52] U.S. Cl. ..... 8/151.2

[51] Int. Cl.[2] ..... D06B 1/04

[58] Field of Search ..... 68/175, 181 R, 184, 68/186, 187, 189, 194, 198, 199, 200, 205 R, 28; 118/325, 420, DIG. 19; 66/125 A; 184/1 R, 15 R; 57/35, 164; 8/150, 155, 151.2

[56] References Cited

UNITED STATES PATENTS

| | | | |
|---|---|---|---|
| 685,910 | 11/1901 | DeKeukelaere | 68/187 |
| 1,948,568 | 2/1934 | Faber et al. | 68/183 X |
| 3,222,857 | 12/1965 | Keyser | 57/164 X |

FOREIGN PATENTS OR APPLICATIONS

| | | | |
|---|---|---|---|
| 333,678 | 9/1903 | France | 68/189 |

*Primary Examiner*—Philip R. Coe
*Attorney, Agent, or Firm*—Paul & Paul

[57] ABSTRACT

A yarn in the form of a supply package in which the yarn is wound on a bobbin is continuously washed with an aqueous washing liquid by standing the yarn supply package upright in means for receiving the yarn package and an aqueous washing liquid, and continuously drawing off the yarn upward from the package while bringing the aqueous washing liquid into contact with the outer surface of the package. The contact of the outer surface of the package with the washing liquid is effected by immersing the package in the washing liquid bath or by flowing the washing liquid down over the outer surface of the package.

6 Claims, 7 Drawing Figures

METHOD FOR CONTINUOUSLY WASHING A YARN WITH A WASHING LIQUID

This is a division of application Ser. No. 465,611, filed Apr. 30, 1974, and now U.S. Pat. No. 3,964,279.

The present invention relates to a method and apparatus for continuously washing a yarn with a washing liquid.

In a yarn producing process, especially, a spun yarn producing process, the yarn is often stained with dust or mist of lubricant. If the processed yarn is a final product, for example, a hand knitting wool yarn, it is necessary to remove the stain from the yarn before forwarding for use. Particularly, if the yarn is a dyed yarn or a bleached yarn, in order to increase brilliancy and color fastness thereof it is very important to clean the yarn.

For this purpose, after the yarn is double-twisted, wound on a bobbin and twist-set in the wound form, the yarn is drawn out from the bobbin and rewound in the form of hank and thereafter, the hank yarn is washed with a washing liquid and rinsed with hot water to remove the stain from the yarn. This type of washing method is effective to improve the color fastness of the yarn and to control fatty substance and soap which are necessary for end use and, thereof, to be retained on the yarn in amounts of 0.8 – 1.2 and 0.4 – 1.0%, respectively, and is valuable for the improvement or the maintenance of the quality of the yarn. Further, the yarn washed in the hank form is dried under tensionless condition to develop crimps on the fibers and to increase bulkiness of the yarn.

However, the above stated method includes many steps, that is, twist setting, hank forming, treating with the washing liquid, rinsing, dehydrating, oiling, drying and rewinding of the yarn. These many steps require a long processing time, complicated operations and much labor. In order to sufficiently wash the yarn, it is necessary that the washing liquid penetrate into the inside of the yarn and the stain on the yarn diffuse into the washing liquid. This penetration and the diffusion require a long treating time. The formation of the hank is effective in promoting the penetration and the diffusion, however, the hank formation and rewinding of the yarn from the hank form to a boal type package also requires a long time and much labor.

It is known that hand knitting wool yarn is continuously processed at a high velocity without hank formation in order to develop crimps on the wool fibers and improve the feel of the wool yarn. For example, in a WP-SPV type of finishing machine of Superba Co., France, the yarn is accumulated in coil form on a conveyor belt circulating through a steamer and steamed in the steamer. This type of the finishing machine is effective for continuously developing crimps on the wool fibers and improving the feel of the wool yarn. However, this process cannot include the washing step. Accordingly, the resultant finished wool yarn sometimes has a poor brilliancy in its hue and an insufficient color fastness. Also, in a GVA type of finishing machine of Horauf Co., Germany, the yarn is continuously impregnated with water while moving, dehydrated to a water content of 40 to 80% based on the weight of the yarn and, thereafter, dried with hot air or steamed. However, in this process, since the impregnation of the yarn with water is carried out in a short time, the penetration of water into the inside of the yarn is insufficient. This insufficient penetration results in poor washing of the yarn.

According to the inventors experiences, in order to sufficiently wash the wool yarn it is necessary that the wool yarn come into contact with the washing liquid for at least 3 seconds, even if the temperature of the washing liquid is high enough to promote the penetration of the washing liquid into the inside of the wool yarn. Further, it is known that when the yarn passes through the washing liquid at a high velocity, a barrier layer of the washing liquid is formed on the yarn surface so as to restrict the penetration of the washing liquid into the inside of the yarn.

The object of the present invention is to provide a method and apparatus for continuously washing a yarn with a washing liquid at a relatively high velocity with an excellent and uniform washing effect.

The above object is accomplished by the method of the present invention. The method of the present invention comprises the steps of

- standing a yarn supply package in which the yarn is wound on a bobbin upright, and
- continuously drawing off a yarn from the yarn package and,
- supplying, concurrently with said drawing operation, a washing liquid to a top end of said yarn package over the outer surface of said yarn package, a portion of said washing liquid being allowed to penetrate into said yarn package.

The method of the present invention is carried out by using the apparatus of the present invention. The apparatus of the present invention comprises, in combination,

- means for receiving a yarn supply package in which the yarn is wound, standing upright and a washing liquid,
- means for continuously drawing off a yarn upward from said package,
- a conduit for feeding said washing liquid into said receiving means, and
- a conduit for discharging said washing liquid from said receiving means.

The method of the present invention may be applied to wash any type of spun or continuous filament yarn. That is, spun yarns such as, for example, wool yarn, cotton yarn, rayon staple yarn, synthetic staple yarn, and continuous filament yarns such as, for example, silk yarn, rayon filament yarn and synthetic filament yarn may be used.

In the method of the present invention, the aqueous washing liquid may be prepared by dissolving a suitable amount of a detergent in water, preferably, hot water. The detergent may be selected from any type of anionic detergent or non-ionic detergent. Especially, sodium alkylbenzene sulfonate is valuable as the detergent for the method of the present invention. The aqueous washing liquid may be heated at a suitable temperature, preferably, from 30° to 70° C.

In the method of the present invention, since the drawing off of the yarn from the yarn package is carried out while bringing the aqueous washing liquid into contact with the outer surface of the package, the continuous drawing off operation of the yarn results in continually exposing a fresh outer surface on the package to the washing liquid and the fresh out surface being washed with the washing liquid. The portion of the yarn located at the exposed outer surface continues in contact with the washing liquid until that yarn portion is drawn off from the package. This contact time is relatively long, more than 3 seconds. Accordingly, the washing liquid can sufficiently penetrate into the inside of the yarn and the stain on the yarn can sufficiently diffuse into the washing liquid. This sufficient penetration and diffusion result in complete washing of the yarn.

The features and advantages of the present invention will be illustrated in detail with reference to the accompanying drawings in which.

Figure 1:
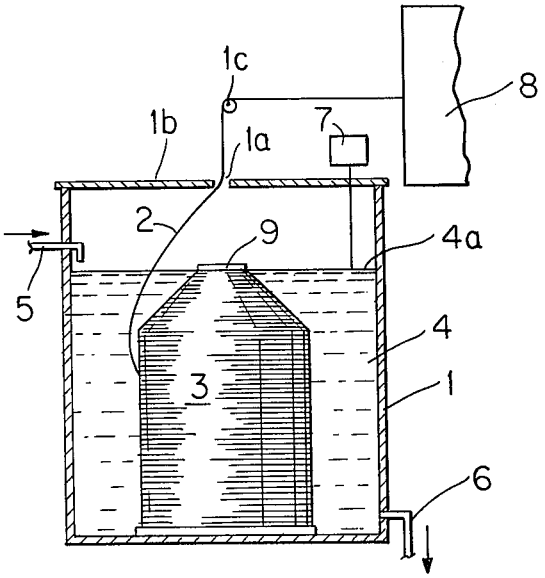
FIG. 1 is a schematic partial cross-sectional view of an embodiment of the apparatus of the present invention wherein a yarn supply package is immersed in a washing liquid.

Referring to FIG. 1, a yarn supply package 3 wherein a yarn 2 is wound around a bobbin 9, stands upright in a washing vessel 1 containing washing liquid 4. The package 3 is completely immersed in the washing liquid 4. The washing liquid 4 is fed into the washing vessel 1 through a feed conduit 5 and discharged from the vessel 1 through a discharge conduit 6. The washing liquid 4 in the vessel 1 is maintained at a present level 4*a* by means of a level controller 7. The washing liquid is also maintained at a predetermined composition and concentration of a detergent contained therein and at a preset temperature by a washing liquid supply means which will be explained hereinafter. The yarn 2 is drawn off upward from the yarn supply package 3 and fed into a device 8 for rinsing the yarn 2 with water through a hole 1*a* formed in a lid 1*b* covering the vessel 1 and a guide roller 1*c*.

The outer surface portion of the package 3 is washed with the washing liquid surrounding the outer surface portion, and the yarn 2 drawn away from the outer surface of the package 3 is further washed with the washing liquid while traveling therethrough. The drawn off yarn 2 is, if necessary, rinsed with water. The rinsed yarn 2 is fed into a dryer (not shown in FIG. 1), and the dried yarn is supplied to a desired device, for example, a rewinding machine (not shown in the drawing).

In the apparatus of FIG. 1, since the yarn supply package is immersed in the washing liquid bath, the washing liquid penetrates into the outer surface portion of the package to wash the yarn located at the outer surface portion. The continuous drawing off of the yarn from the package continually exposes a fresh outer surface to the washing liquid and the fresh outer surface is washed with the washing liquid penetrated thereinto. The yarn is further washed with the washing liquid while traveling therethrough.

Figure 2:
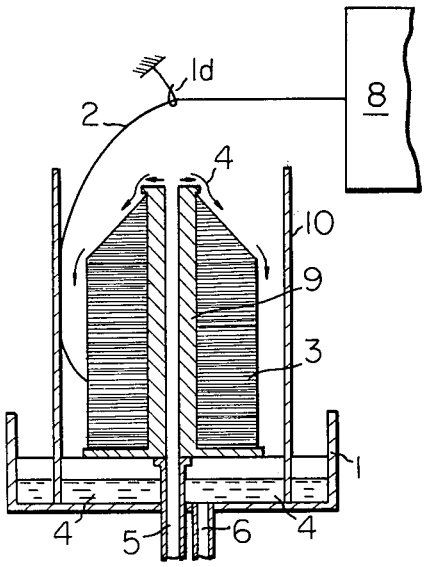
FIG. 2 is a schematic cross-sectional view of another embodiment of the apparatus of the present invention wherein a washing liquid is fed onto the outer surface of a yarn supply package through a hollow bobbin on which the yarn is wound.

Referring to FIG. 2, a yarn supply package 3 is stood upright in a cylinder 10 located in a vessel 1. The package 3 is constructed of a yarn 2 wound around a hollow bobbin 9. The hollow bobbin 9 is connected, at its lower end, to a washing liquid feed conduit 5 which is connected to a supply source of the washing liquid (not shown in the drawing). When the washing liquid 4 is fed from the supply source through the conduit 5, the washing liquid flows upward through the inside of the hollow bobbin 9 and, then, flows down gravitationally over the outer surface of the package 3 while washing the yarn 2 located at the outer surface portion of the package 3. Thereafter, the washing liquid 4 is received by the vessel 1 and, then, discharged through a discharge conduit 6 connected to the bottom of the vessel 1. The yarn 2 located at the outer surface portion of the package 3 is washed with the washing liquid flowing down thereover and successively drawn off therefrom. The drawn off yarn 2 is, if necessary, fed into a rinsing device 8 through a guide hook 1*d*. After rinsing in the device 8, the yarn 2 is dried in a heater (not shown in the drawing).

The cylinder 10 has enough diameter and a height to receive the yarn supply package 3 therein and may have a vertical slit which opens at its upper end. Through the slit, the tail end of the yarn wound on the package is connected to the leading end of a yarn of an immediately following package.

The cylinder 10 is effective in restricting a ballooning tension created on the yarn when the yarn is drawn off from the package at high velocity. The continuous drawing off of the yarn continually results in exposure of a fresh outer surface of the package to washing liquid which is supplied through the hollow bobbin. The fresh outer surface portion is washed with the washing liquid flowing down over the surface.

Figure 3:
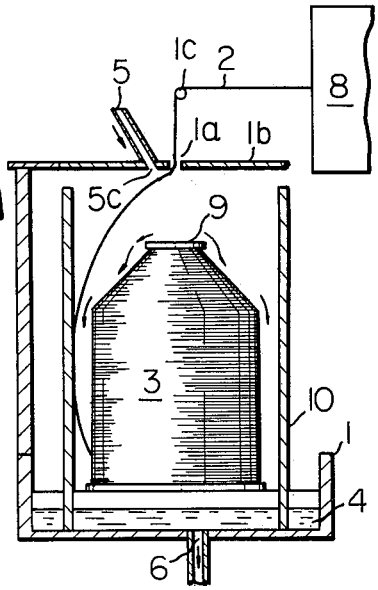
FIG. 3 is a schematic partial view of a further embodiment of the apparatus of the present invention wherein a washing liquid is fed onto the outer surface of a yarn supply package through a spout located above the package.

In FIG. 3, a yarn supply package 3 is stood upright in a cylinder 10 located in a vessel 1 for receiving the washing liquid 4. A lid 1*b* is arranged above the cylinder 10. A conduit 5 for feeding the washing liquid 4 is connected at its lower end to an opening 5*c* formed in the lid 1*b*. The other end of the conduit 5 is connected to a supply source of the washing liquid (not shown in the drawing). The conduit 5 and the opening 5*c* are formed so as to be directed toward the head portion of the bobbin 9 on which the yarn 2 is wound. The lid 1*b* has another opening 1*a* through which the yarn 2 is drawn out upward. A discharge conduit 6 is connected to the bottom of the vessel 1. The washing liquid is fed from the supply source (not shown) through the conduit 5 and spouted through the opening 5*c* toward the head portion of the bobbin 9. The washing liquid, thereafter, flows down gravitationally over the outer surface of the yarn supply package, and is received by the vessel 1. Finally, the washing liquid is discharged from the vessel 1 through the discharge conduit 6. While flowing down over the outer surface of the package, the washing liquid penetrates into the outer surface portion and washes the yarn located thereat. The washed yarn is successively drawn away from the outer surface portion of the package. The continuous drawing off of the yarn results in continually exposing a fresh outer surface of the package to the washing liquid flow. The fresh outer portion is washed with the flow of the washing liquid. The washed yarn 2 is drawn away from the outer surface portion of the package 3 and, if necessary, fed into a rinsing device 8 through a guide roller 1*c*. After complete rinsing, the yarn 2 is dried by a dryer (not shown in the drawing).

In the process of the present invention, the washing liquid is brought into contact with the outer surface portion of the yarn supply package so that the portion of the yarn located at the outer portion is washed with the washing liquid, and the washed yarn is continuously drawn off from the package. In the period from the contact of the yarn with the washing liquid to the drawing off of the yarn, the washing liquid can penetrate into the inside of the yarn located at the outer surface portion of the package and extract stains on the yarn thereinto. This washing time is considerably long, that is, more than 3 seconds. Accordingly, the yarn is continuously and uniformly washed by the washing liquid under a constant condition.

In the case of the apparatus as shown in FIG. 1, the yarn can be further washed while traveling through the washing liquid bath. However, the washing liquid bath tends to resist the traveling of the yarn due to the viscosity of the washing liquid. This resistance results in a large tension on the yarn traveling through the washing liquid bath.

In the cases where the apparatuses of FIGS. 2 and 3 are utilized, in the drawing off from the package, the yarn travels only through the atmospheric air which has a negligible viscosity in comparison with that of the washing liquid. This results in a small tension on the yarn. Accordingly, in the apparatus of FIGS. 2 and 3, the yarn can be drawn off at a higher velocity than that in FIG. 1. Further, in the apparatus of FIGS. 2 and 3, the flow of the washing liquid over the outer surface of the package tends to promote the removal of stains from the yarn.

Figure 4:
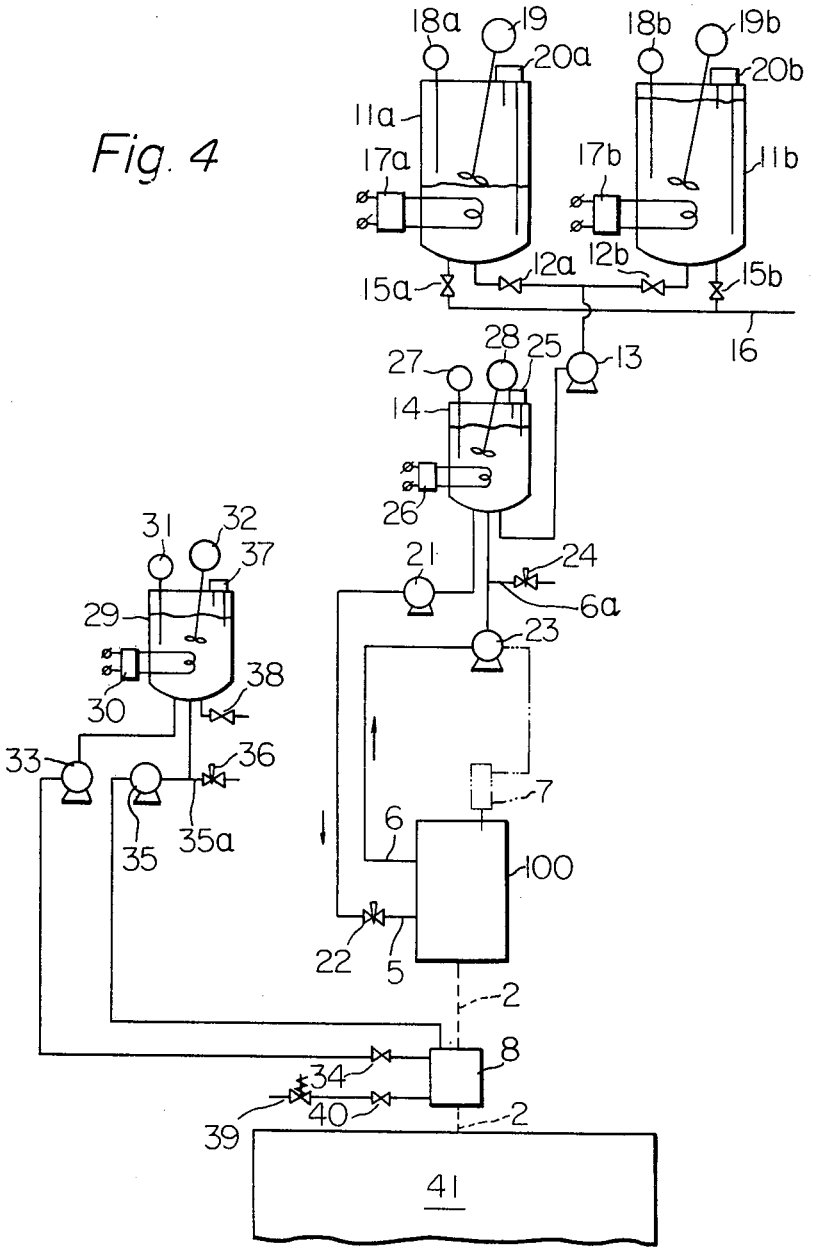
FIG. 4 shows an arrangement for circulating a washing liquid through an apparatus of the present invention.

FIG. 4 shows a circulation system for supplying the washing liquid into the washing apparatus.

Referring to FIG. 4, a first vessel 11*a* and a second vessel 11*b* for preparing therein the washing liquid are connected to a third vessel 14 for the storage of the washing liquid through a pump 13. When the washing liquid is sent from the first vessel 11*a* to the third vessel 14, an automatic valve 12*a* is opened and an automatic valve 12*b* is closed, and fresh washing liquid is prepared in the second vessel 11*b*. When the washing liquid is sent from the second vessel 11*b* to the third vessel 14, the valve 12*a* is closed and the valve 12*b* is opened and fresh washing liquid is prepared in the first vessel 11*a*. That is, the vessels 11*a* and 11*b* are alternately used to prepare and supply the washing liquid to the third vessel 14. In order to prepare the washing liquid in the vessels 11*a* and 11*b*, a predetermined amount of water if fed into the vessels 11*a* and 11*b* through a common water conduit 16 and automatic valves 15*a* and 15*b*, a predetermined amount of a detergent is added to water, the mixture is heated by heaters 17*a* and 17*b* to a preset temperature and stirred by stirrers 19*a* and 19*b* for a preset time. The temperature of the washing liquid is controlled at the predetermined level by thermocontrollers 18*a* and 18*b*. Upper and lower limits in the level of the washing liquid in the vessels are controlled by level controllers 20*a* and 20*b*. These valves 12*a*, 12*b*, 15*a* and 15*b*, pump 13, stirrers 19*a* and 19*b*, level controllers 20*a* and 20*b*, thermocontrollers 18*a* and 18*b* and heaters 17*a* and 17*b* may be automatically operated in accordance with a preset program.

The third vessel 14 is provided with a heater 26, a level controller 25, a stirrer 28 and thermocontroller 27. The washing liquid is supplied from the third vessel 14 to a washing apparatus 100 through a pump 21, a needle valve 22 and a supply conduit 5. After the washing liquid is used to wash the yarn, the washing liquid is recovered into the vessel 14 through a recovery conduit 6 and a pump 23. A portion of the washing liquid recovered from the washing apparatus 100 is continuously discharged outside of the system through a conduit 6*a*, which branches off from the conduit 6 between the pump 23 and the vessel 14, and through a needle valve 24. The amount of the washing liquid to be discharged is adjusted by the needle valve 24. In order to compensate for the amount of the discharged washing liquid, an amount of fresh washing liquid is continuously supplied from the first or second vessel 11*a* or 11*b* to the third vessel 14. This supply operation is controlled by the level controller 25. That is, when the level of the washing liquid in the vessel 14 becomes lower than a lower limit of the level preset in the level controller 25, the pump 13 is actuated and one of the closed valve 12*a* or 12*b* is opened, and when the level of the washing liquid exceeds an upper limit of the level preset in the level controller 24, the pump 13 is stopped and the valve 12*a* or 12*b* which was previously opened is closed. The above control operations may be carried out automatically. In the case where the apparatus of FIG. 1 is used, it is necessary to control the amount of the washing liquid in the washing vessel 1 in such a manner that it is always at a constant level, at which level the yarn supply package is completely immersed in the washing liquid. This control is effected by the level controller 7. When the level controller 7 detects a higher level of the washing liquid in the washing vessel 1 than an upper limit preset therein, the pump 23 is stopped. When a level lower than a preset lower limit of the washing liquid level is detected by the level controller 7, the pump 23 is activated to supply the washing liquid to the washing vessel 1.

FIG. 4 also shows a system for rinsing the washed yarn which has been drawn off from the washing apparatus 100. Referring to the drawing, a vessel 29 for containing hot water is provided with a heater 30, a thermocontroller 31, a stirrer 32 and a level controller 37. The hot water prepared in the vessel 29 is fed under pressure into a rinsing device 8 through a pump 33 and an automatic valve 34. After completion of rinsing, the hot water is recovered from the rinsing device 8 into the vessel 29 through a pump 35. A predetermined amount of the recovered hot water is discharged outside the system through a branch conduit 35*a* located between the pump 35 and the vessel 29 and a needle valve 36. The amount of the recovered hot water to be discharged is adjusted by the needle valve 36. In order to compensate for the discharge, an amount of fresh water is fed into the hot water vessel 29. That is, when the level of the hot water in the vessel 29 becomes lower than a lower limit preset in the level controller 37, a water supply valve 38 is opened and fresh water is fed into the vessel 29. When the level controller 37 detects a level of the hot water higher than an upper limit preset in the controller 37, the water supply is stopped by closing the valve 38. The hot water is directed toward the washed yarn 2 fed into the rinsing device 8 by pressurized air. The pressurized air is fed from an air compressor (not shown in the drawing) through a pressure-reducing valve 39 and an automatic valve 40. The pressurized air is kept at a constant pressure by means of the pressure reducing valve 39. When the supply of the hot water is stopped, the feed of the pressurized air is automatically stopped by the automatic valve 40. After completion of the rinsing, the rinsed yarn 2 is fed into a drier 41 and dried therein.

Figure 5:
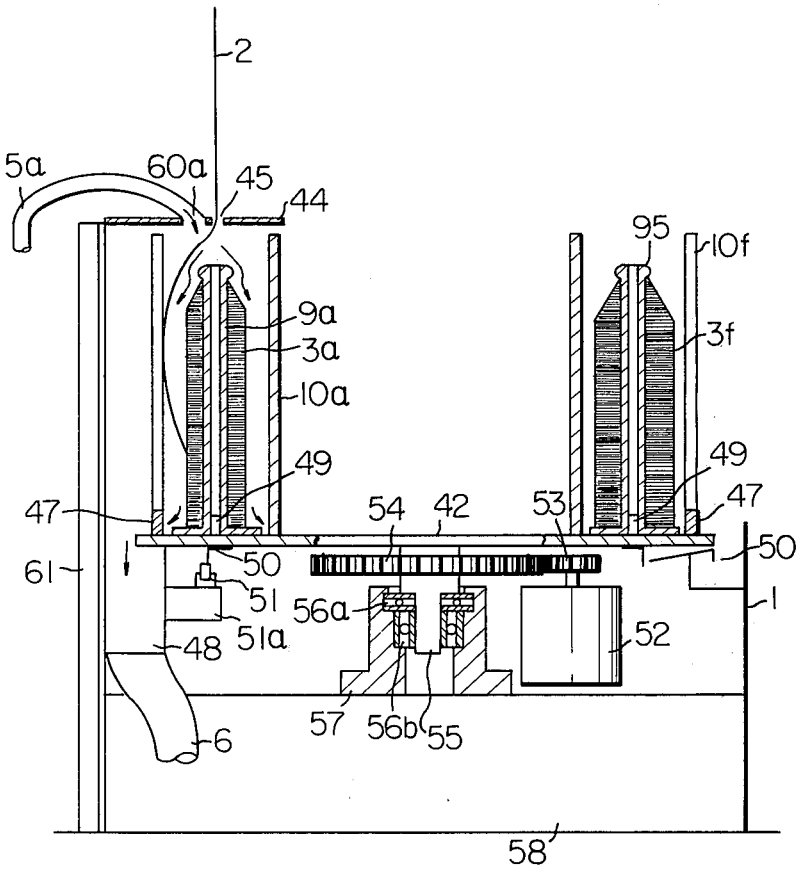
FIG. 5 is a cross-sectional view of an embodiment of an apparatus of the present invention along line V—V in FIG. 7.
Figure 6:
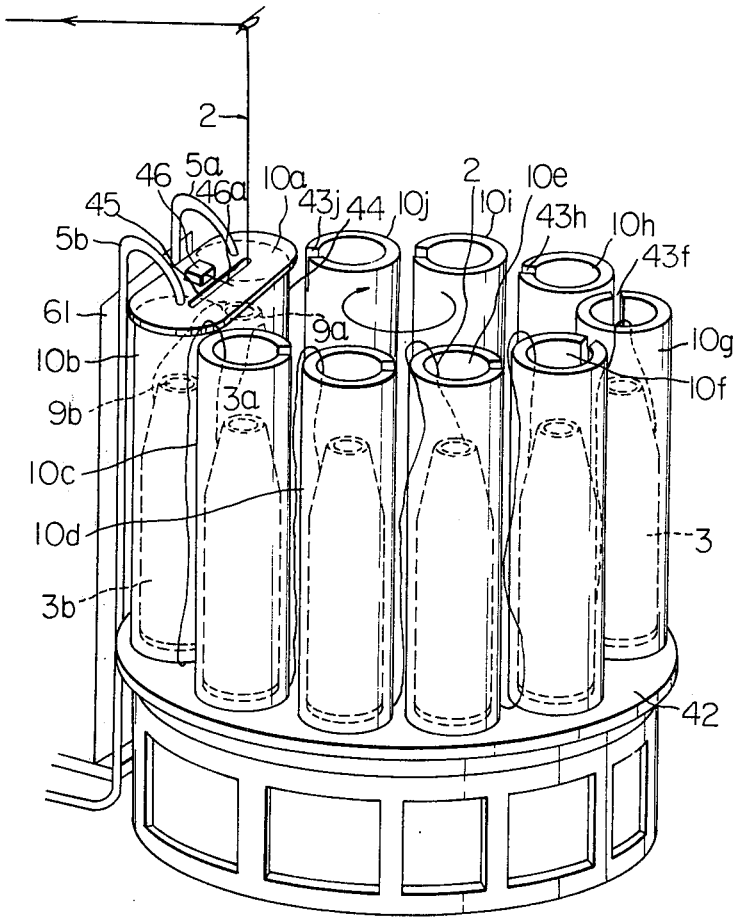
FIG. 6 is a perspective view of the apparatus of the present invention shown in FIG. 5.
Figure 7:
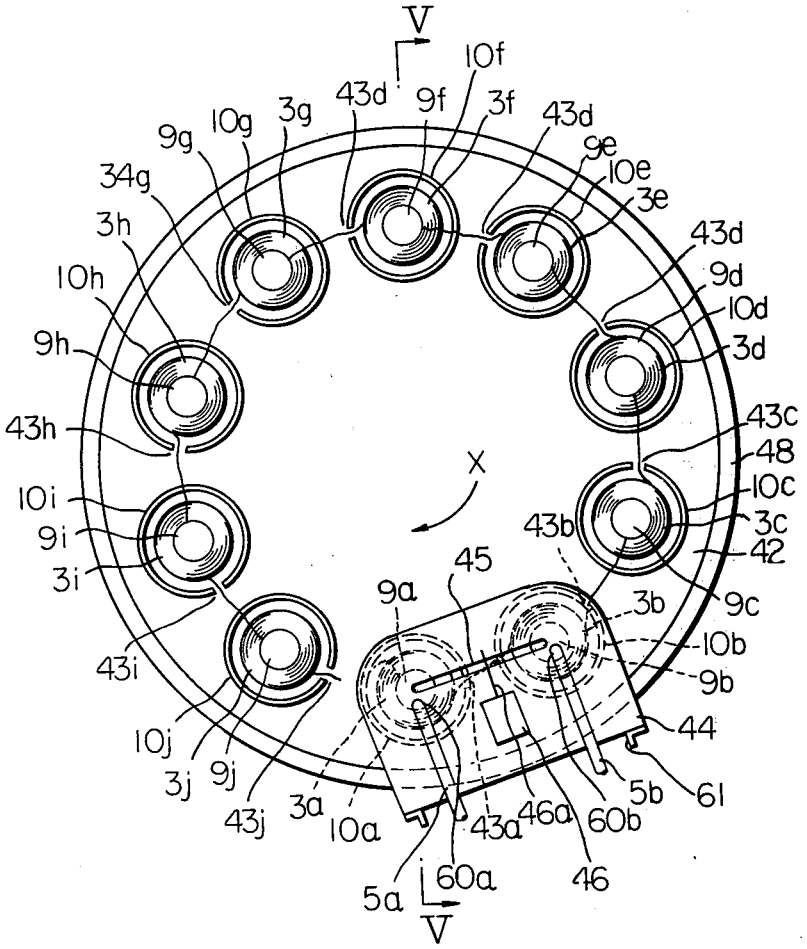
FIG. 7 is a plane view of the apparatus of FIGS. 5 and 6.

Referring to FIGS. 5 through 7, a plurality of vertical cylinders 10*a* through 10*j* are arranged on a circular turret type horizontal carriage 42 in a manner such that all of the cross-sectional centers of the cylinders are on a round with equal intervals therebetween. The cylinders have vertical slits 43*a* through 43*j* formed on the side walls thereof. Each vertical slit is open at its top end. As FIGS. 6 and 7 show, each of the slits 43*a* through 43*j* is located along the round on which all of the cross-sectional centers of the cylinders are arranged, and all of the slits are on the same side of their respective cylinders with respect to the radius extending from a center of the round to the cross-sectional center of their cylinder. When the carriage 42 rotates in the direction of an arrow X in FIGS. 6 and 7, each of the slits is located on the rear side of its cylinder with respect to the corresponding radius. Referring to FIGS. 5 through 7, a horizontal lid plate 44 supported by a stand 61 is arranged so as to cover an adjacent two of the cylinders 10*a* through 10*j* with a small clearance between the lower surface of the lid 44 and the top ends of the cylinders. In these drawings, the cylinders 10*a* and 10*b* are covered by the lid 44. The lid 44 has a slit 45 extending from a point just above the cross-sectional center of the cylinder 10*a* to a point just above that of the cylinder 10*b*.

Through the slit 45, the yarns of packages 3*a* and 3*b* charged in the cylinders 10*a* and 10*b* are drawn off upwardly. The lid 44 also has two openings 60*a* and 60*b*. Conduits 5*a* and 5*b* are respectively connected to the openings 60*a* and 60*b*. When washing liquid is fed from a supply source (not shown in the drawing) through the conduits 5*a* and 5*b*, the washing liquid is spouted through the openings 60*a* and 60*b* toward the head portions of the bobbins 9*a* and 9*b* of the yarn supply packages 3*a* and 3*b*. The spouted washing liquid flows down, so as to cover the outer surface of the packages 3*a* and 3*b*, to the bottoms of the cylinders 10*a* and 10*b*. Each cylinder has a hole 47 formed at the lower end of its side wall. The washing liquid is discharged from the cylinder bottoms through the hole 47 to a vessel 48. The washing liquid is received by the vessel 48 and discharged to the outside of the apparatus through the discharged conduit 6.

Referring to FIGS. 6 and 7, a limit switch 46 having a detector part 46*a* composed of a flexible wire, is fixed on the lid 44 so that the flexible wire 46*a* crosses the slit 45. Referring to FIG. 5, a plurality of pegs 49 are disposed on the carriage 42 at positions at which the bobbins 9*a* through 9*j* are secured, and a plurality of projections 50 are disposed on the lower surface of the carriage 42 at positions corresponding to the pegs 49. A limit switch 51 is disposed on a support 51*a*, so as to be able to contact the projection 50 located below the cylinder 10*a*. A center shaft 55 extends from the lower surface of the carriage 42 and is supported by bearings 56*a* and 56*b* and a support 57. The carriage 42 can rotate around the shaft 55. A motor 52 is connected to the carriage shaft 55 through gears 53 and 54. The above-stated devices are mounted on a frame 58.

In the working operation of the apparatus of FIGS. 5 through 7, yarn supply packages 3*a* through 3*j* are respectively charged upright into the cylinders 10*a* through 10*j* so that the bobbins 9*a* through 9*j* are engaged with the corresponding pegs 49 on the carriage 42. The tail end of the yarn on a preceding package is taken up through the slit of the cylinder in which the package is charged, and combined with the leading end of the yarn on an immediately following package.

In order to place a yarn supply package at a position where the yarn is drawn off through the slit 45 of the lid 44, the motor 52 is actuated. When the cylinder containing the package comes to the position of cylinder 10*a* and a projection 50 located below the cylinder 10*a* is brought into contact with the limit switch 51, the limit switch 51 is actuated so as to stop the motor 52.

In the apparatus as shown in FIGS. 5 through 7, the adjacent two yarn supply packages 3*a* and 3*b* are simultaneously washed with the washing liquid. The washing liquid supplied through the conduit 5*a* is spouted to the preceding package 3*a* at a relatively large flow rate so that the outer surface portion of the preceding package 3*a* is sufficiently washed by the washing liquid flowing down over the outer surface. The washing liquid fed through conduit 5*b* is spouted to the following adjacent package 3*b* at a relatively smaller flow rate so that the outer surface portion thereof is preliminarily washed with the washing liquid. The drawing off of the yarn is effected from the preceding package 3*a*. When the drawing off from the preceding package 3*a* is completed, the tail end of the yarn of the preceding package 3*a* which end has been combined with the leading end of the yarn of the immediately following package 3*b*, is brought into contact with the flexible wire 46*a* of the limit switch 46 so as to actuate the switch 46. By this operation, the rotation of the carriage 42 is limited to a predetermined angle and the immediately following package 3*b* is brought to the drawing off position for the yarn.

By repeating the above operations, the yarn in the package 3*a* through 3*j* can be successively washed and continuously drawn off from the packages.

In the apparatus as shown in FIGS. 5 through 7, the number of the cylinder may be optionally determined, that is, at least two. Also, the number of the washing liquid spouts may be optionally determined.

The following examples are intended to illustrate the application of the present invention but are not intended to limit the scope of the present invention.

EXAMPLE 1

A yarn package was prepared from a hand knitting pure wool yarn of a medium thickness (four component yarns/16 metric count) which had been dyed pink with a mixture of 4.3% of Levafix Brilliant Red F4B and 2.2% of Levafix Yellow ERL (both the dyes are trademarks of reactive dyes made by Bayer), based on the weight of the yarn.

The yarn package was cleaned at a temperature of 40° C with a washing liquid containing 0.25% by weight of sodium alkylbenzene sulfonate in water, using an apparatus as shown in FIG. 1.

The package was immersed in the washing liquid bath and the yarn was drawn off from the package through the washing liquid at a draw off rate of 300 m/min. The yarn thus drawn off was continuously squeezed by a pair of nip rollers to a water content of 65% based on the weight of the yarn without rinsing with water and, then, dried at a temperature of 100° C. The above operations were carried out without difficulty.

The yarn thus cleaned had a brilliant pink hue and an excellent color fastness of class 5 to water, perspiration, washing, and rubbing.

The yarn had an excellent color fastness to light. It was confirmed that the cleaned yarn retained thereon small percentages of 1.09 of fatty substance and 0.86 of soap based on the weight of the yarn.

EXAMPLE 2

A yarn package was prepared from a hand knitting pure wool yarn of medium thickness (four component yarns/16 metric count) which had been dyed navy blue with a mixture 1.64% of Mitsui Chrome Pure Blue BX (trademark of a mordant dye made by Mitsui-Toatsu, Japan), 0.3% of Diamond Navy Blue 2RN (trademark of a mordant dye made by Bayer) and 0.09% of Cyanine AU Chrome R (trademark of a mordant dye made by Francolor) based on the weight of the yarn.

The yarn was continuously washed at a temperature of 40° C using the apparatus as shown in FIG. 1 containing a washing liquid which has been prepared by dissolving 0.40% by weight of sodium alkylbenzene sulfonate in water. The yarn was drawn off from the package through the washing liquid bath at a draw off rate of 360 m/min, and squeezed to a water content of 65% based on the weight of the yarn and, then, dried. These operations were carried out without difficulty.

The yarn thus cleaned had an excellent color fastness to water, perspiration and washing, each evaluated in class 5, and a good color fastness to rubbing of class 4–5. By measurement it was found that small percentages of 1.09 of fatty substance and 0.86 of soap based on the weight of the yarn were retained on the yarn.

For comparison, the same dyed yarn as used above was accumulated in coil form on a conveyer belt circulating through a steamer and treated with steam to increase the bulkiness of the yarn without washing. The yarn thus treated had a color fastness of class 4 to water, perspiration and washing and of class 3 to rubbing. The comparison yarn was poorer in color fastness than the yarn washed by the process of the present invention.

EXAMPLE 3

A yarn package was prepared from a hand knitting pure wool yarn of a middle thickness (four component yarns/16 metric count) which had been dyed red with the same dye mixture as used in Example 1.

The yarn package was charged into a washing apparatus as shown in FIG. 2. A washing liquid containing 0.35% by weight of sodium alkylbenzene sulfonate in water was fed, at a temperature of 40° C, to a hollow bobbin, on which the yarn was wound, through the bobbin's lower end at a flow rate of 25 l/hour. The fed washing liquid flowed down over the entire outer surface of the yarn package. The yarn was drawn off from the package at a draw off rate of 610 m/min, squeezed by a pair of nip rollers to a water content of 65% based on the weight of yarn and, then, dried at a temperature of 100° C. The above operations were effected without difficulty.

The red yarn thus cleaned had an excellent brilliancy and a superior color fastness of class 5 to water, perspiration, washing and rubbing. The red yarn also had an excellent color fastness to artificial light. It was determined that the cleaned yarn retained thereon small percentages of 0.98 of fatty substance and 0.85 of soap based on the weight of the yarn. These small amounts of fatty substance and soap on the yarn resulted in the yarn having a good feel to the hand.

EXAMPLE 4

The same procedures as in Example 4 were repeated except that the hand knitting pure wool yarn was dyed navy blue with the same dye mixture as in Example 2, that the concentration of the sodium alkylbenzene sulfonate in the washing liquid was 0.40% by weight, that the draw off rate of the yarn was 600 m/min and that the washed yarn was squeezed to a water content of 73% based on the weight of the yarn. The yarn thus washed had a superior color fastness of class 5 to water, perspiration and washing and of class 4–5 to rubbing. It was determined that the cleaned yarn retained thereon small amounts of 0.87% of fatty substance and of 0.78% of soap based on the weight of the yarn. The above washing operations were carried out without difficulty and the resultant yarn had a good feel to the hand.

EXAMPLE 5

The apparatus as shown in FIGS. 5 through 7 was used. A washing liquid was prepared by dissolving 0.3% by weight of sodium alkylbenzene sulfonate in hot water.

Referring to FIGS. 5 through 7, ten yarn packages 3*a* through 3*j* were prepared, each by winding a hand knitting pure wool yarn of a coarse thickness (three component yarns/10 metric count) which had been dyed yellow with 0.036% of Kayaku Acid Flavine FF (trademark of an acid dye made by Nihon Kayaku, Japan) based on the weight of the yarn, around bobbins 9*a* through 9*j*. The packages 3*a* through 3*j* were respectively charged into cylinders 10*a* through 10*j* on the rotatable carriage 4–2. The tail ends of the yarns of the packages 3*a* through 3*i* were successively joined with leading ends of the yarns of the following packages 3*b* through 3*j* through the respective slits 43*a* through 43*i*. The washing liquid was spouted at a temperature of 40° C toward the head of the bobbin 9*a* through the conduit 5*a*, at a flow rate of 25 l/hour, and toward the head of the bobbin 9*b* through the conduit 5*b*, at a flow rate 10 l/hour. The outer surfaces of the packages 3*a* and 3*b* were washed with the washing liquid flowing down thereon. The yarn was drawn off from the package 3*a* through the slit 45 at a draw off rate of 550 m/min. The drawing off for the package 3*a* was completed about 13 minutes after the start of the drawing off. When the tail end portion of the yarn in the package 3*a* was drawn off, the tail end came into contact with the flexible wire 46*a* of the limit switch 46. This contact caused the rotation of the carriage 42. When the cylinder 10*b* containing package 3*b* came to the position which was initially occupied by the cylinder 10*a* containing the package 3*a*, a projection (not shown in the drawings) located below the cylinder 10*b* actuated the limit switch 51 to stop the rotation of the carriage 42. The drawing out operation of the yarn was then begun for the package 3*b*. The drawn off yarn was continuously rinsed with hot water spouted toward the yarn, dehydrated by action of the air jet and then dried at a temperature of 100° C.

The above operations were successively applied to the yarn of every package.

The cleaned yarn of every package had an excellent brilliance and superior a color fastness of class 5 to water, perspiration, washing and rubbing. It was determined that every yarn retained thereon, in average, a small amount 1.05% of fatty substance and 0.60% of soap.

What we claim is:

1. A method for continuously washing a yarn with a washing liquid, comprising the steps of:

standing upright a yarn supply package in which the yarn is wound on a bobbin, continuously drawing off the yarn from said yarn package upwardly, and, supplying, concurrently with said drawing operation, a washing liquid to a top end of said yarn package while allowing said washing liquid to flow downwardly from said top end of said yarn package over the outer surface of said yarn package, a portion of said washing liquid being allowed to penetrate into said yarn package.

2. A method as claimed in claim 1, wherein said washing liquid has a temperature of 30° to 70° C.

3. A method as claimed in claim 1, wherein the bobbin of said yarn package is a hollow bobbin, and the washing liquid is urged from the bottom to the top of the package through said hollow bobbin, said washing liquid flowing downwardly from the top of the yarn package over the outer surface of said yarn package.

4. A method as claimed in claim 1, wherein the washing liquid is spouted toward the top end of the yarn package.

5. A method as claimed in claim 1, wherein the washing liquid is an aqueous solution of a detergent.

6. A method as claimed in claim 1, wherein the washing liquid which has flowed down from the outer surface of the yarn package, is supplied again to the top end of the yarn package.

* * * * *